United States Patent [19]

Baran

[11] 4,161,149

[45] Jul. 17, 1979

[54] CUTTING APPARATUS FOR FLATBED SEWING MACHINE

[75] Inventor: Miroslav Baran, Trenton, Canada

[73] Assignee: Bata Shoe Company, Inc., Belcamp, Md.

[21] Appl. No.: 794,252

[22] Filed: May 5, 1977

[30] Foreign Application Priority Data

May 12, 1976 [CA] Canada ..... 252340

[51] Int. Cl.[2] ..... D05B 37/04

[52] U.S. Cl. ..... 112/130; 30/275; 112/300

[58] Field of Search ..... 112/130, 129, 252, 122, 112/300; 83/699, 623, 700, 365, 694, 523; 242/147 R, 75, 75.44, 75.51, 75.52; 30/275, 286

[56] References Cited

U.S. PATENT DOCUMENTS

| | | | |
|---|---|---|---|
| 691,090 | 1/1902 | Waring | 30/275 |
| 3,170,349 | 2/1965 | Weinkle | 112/130 X |
| 3,789,782 | 2/1974 | Speer | 112/130 |
| 3,857,346 | 12/1974 | Dal Negro | 112/130 |
| 3,972,296 | 8/1976 | Marforio | 112/130 X |
| 3,973,506 | 8/1976 | Rinehimer et al. | 112/130 |
| 3,986,467 | 10/1976 | Hornkohl | 112/130 X |
| 4,040,366 | 8/1977 | Silverman et al. | 112/130 X |

*Primary Examiner*—Werner H. Schroeder
*Assistant Examiner*—Moshe I. Cohen
*Attorney, Agent, or Firm*—Holman & Stern

[57] ABSTRACT

A cutting apparatus for cutting a strip of tape connected to a shoe upper component and extending beyond the edges thereof includes a blade for cutting the tape and presser feet for tensioning the tape during cutting. The blade and presser feet are independently actuated by plungers, which are slidable in a casing mounted on the sewing machine used to sew the tape onto the upper component. The plungers are provided with magnetic cores, and separate coils around the cores are energized in response to signals from photosensors in the work surface of the sewing machine to effect tensioning of the tape, followed by cutting at the edge of the upper component. Springs in the casing around the plungers return the plungers to a rest position, and the tape tensioning and cutting operations are repeated at each component edge.

4 Claims, 9 Drawing Figures

CUTTING APPARATUS FOR FLATBED SEWING MACHINE

BACKGROUND OF THE INVENTION

1. Field of the Invention

This invention relates to an electromagnetic cutting apparatus for use with sewing machines, and in particular with flatbed sewing machines.

2. Description of the Prior Art

Applicant's Canadian Pat. No. 932,650, issued Aug. 28, 1973 discloses an electromagnetic cutting apparatus for cutting a strip of binding tape sewed onto shoe upper components. The cutting apparatus includes an electromagnetically operated plunger with a blade on the outer end thereof for cutting the tape at the leading and trailing edges of each component. The edges of the components in the vicinity of the tape are detected by means of photosensors mounted in the work surface of the apparatus. As the components and tape pass over the work surface, they occlude or open the photosensors to light from a light source mounted above such work surface. The photosensors form part of a control circuit for actuating the plunger to perform a cutting action.

The apparatus described in the above-identified Canadian patent is intended to facilitate automatic rapid and accurate cutting of a binding tape between a plurality of components fed from a sewing machine. The apparatus does, in fact, perform in the intended manner. A drawback of such apparatus is that it utilizes an impact cutting action in which the strip to be cut is guillotined by a blade driven against a hard metal insert in an anvil over which the strip is passed. With a flatbed sewing machine, there is insufficient space for such an anvil and insert arrangement. Moreover, impact cutting using the apparatus described in the above-mentioned Canadian patent is noisy, and considerable force is required for driving the blade through the material forming the strip in order to effect a clean cut.

With a view to reducing the force required to cut the strip of material, and, to a lesser extent, in order to provide a more compact, quieter sewing-cutting system, the inventor has devised a modified cutting apparatus for use with flatbed sewing machines which is connected directly to a slightly modified sewing machine and still performs the desired cutting action in a non-impacting manner and at least as quickly as the patented apparatus.

SUMMARY OF THE INVENTION

The cutting apparatus of the present invention is designed to cut a strip of material connected to a shoe or other component and extending beyond at least one edge thereof, the cutting being performed at such one edge. The apparatus includes blade means for cutting the strip; tension means for tensioning the strip during cutting thereof; first plunger means engaging the tension means; second plunger means engaging the blade means; electromagnetic drive means for moving the first plunger means and tension means from a rest position to a tensioning position on each side of the blade means, and for moving said second plunger means and blade means from a rest position to a cutting position between the tension means; sensor means for actuating said drive means when the component and strip are properly located beneath the blade means; and means for returning the first and second plunger means to the rest position.

More specifically, the tension means takes the form of two presser feet for temporarily holding the strip of material and/or component against the work surface of the sewing machine. Thus, the area of the strip between the presser feet is tensioned for cutting, which occurs when the blade passes through the strip into a slot in the sewing table. With this arrangement, there is no impact on cutting, and the forces required to effect tensioning and cutting are much less than that required for impact cutting.

The apparatus of the present invention is normally installed in a dual needle sewing machine of the type which forms part of a tandem sewing machine system. Minor modifications are made to the feed dog and presser foot of the sewing machine, and a slot for receiving the blade is provided in the throat plate of the machine.

Thus, the resulting combination of sewing and cutting elements is somewhat more compact than a system in which the sewing machine and cutting apparatus are completely separate.

The sensor means used in the apparatus of the present invention is similar to that employed in the device of the above-mentioned Canadian Pat. No. 932,650. However, in the present case, the light source is an infrared source.

DESCRIPTION OF THE PREFERRED EMBODIMENT

Figure 1:
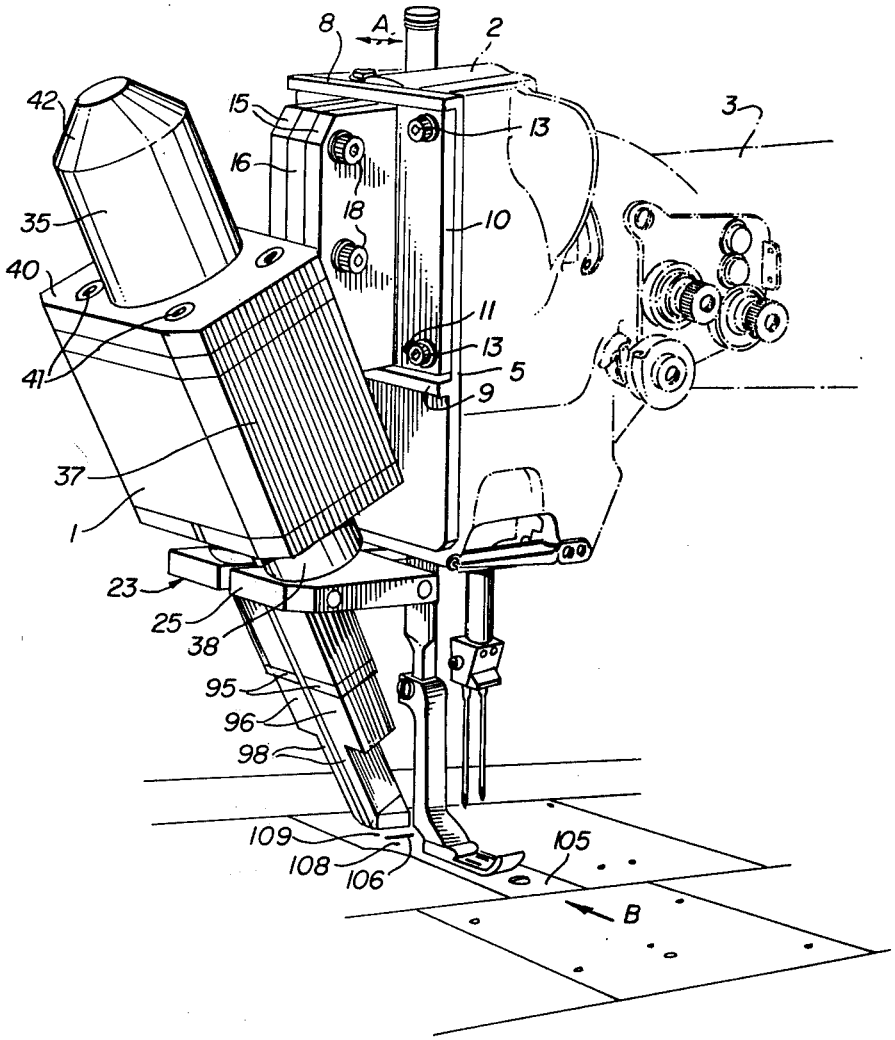
FIG. 1 is a perspective view of one side of the head of a sewing machine incorporating the apparatus of the present invention.
Figure 2:
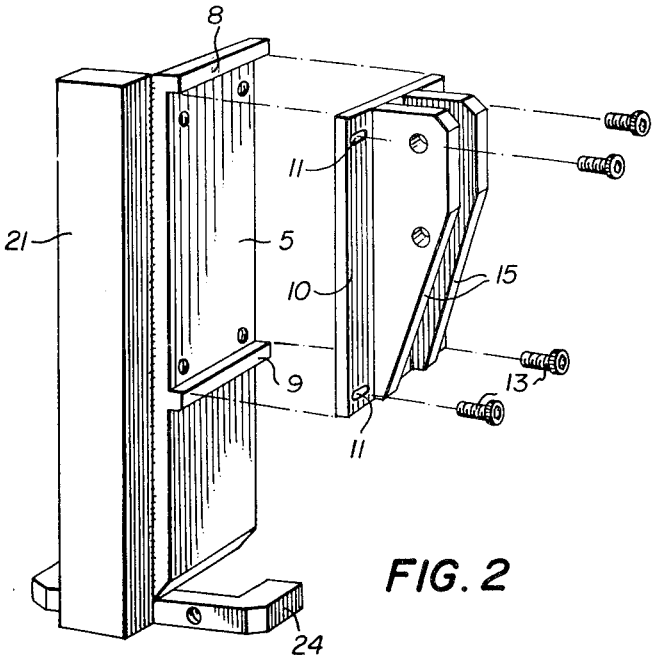
FIG. 2 is an exploded perspective view of elements used to mount the apparatus of FIG. 1 on a sewing machine.
Figure 3:
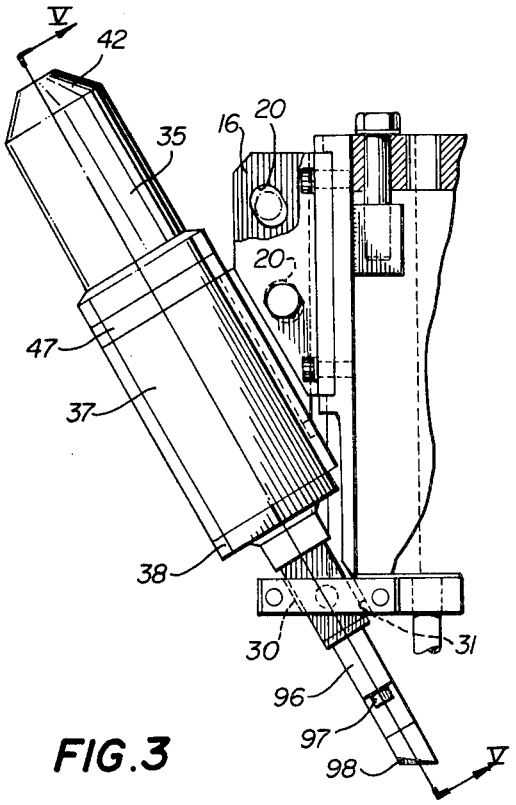
FIG. 3 is a partly sectioned elevation view of the apparatus and sewing machine of FIG. 1.

Referring to the drawings and in particular to FIGS. 1 to 3, the preferred form of cutting apparatus includes a casing 1 adjustably mounted on head end 2 of a flatbed sewing machine 3.

In order to mount the casing 1 on the sewing machine 3, the end piece (not shown) of the sewing machine is replaced with a rectangular back plate 5, which is provided with top and central outwardly extending flanges 8 and 9, respectively from receiving a smaller front plate 10. The front plate 10 (FIG. 2) is provided with enlarged, generally elliptical openings 11 through which pass screws 13 for securing the front plate to the back plate 6. The englarged openings 11 permit adjustment of the position of the front plate 10 in the direction of arrow A. A clevis-like bracket in the form of a pair of outwardly extending parallel flanges 15 is provided on the outer surface of the front plate 10 for receiving an arm 16 extending outwardly from the casing 1. The arm 16 is secured between the flanges 15 by screws 18 extending through enlarged openings 20 in the arm, whereby arm 16 and the casing 1 can be moved vertically.

A vertical bar 21 is welded to one side of the back plate 5, and supports one half of a bracket generally indicated at 23 (FIG. 1) for supporting the lower end of the casing 1. The bracket 23 includes two generally C-shaped portions 24 and 25, one of which is connected to the bar 21 and the other of which is connected to the first portion 24 by screws 27. By loosening the screws 27, the vertical position of the casing 1 and its associated elements can be adjusted. The portions 24 and 25 of the bracket 23 define a rectangular opening 29 having inclined front and rear surfaces 30 and 31, respectively permitting passage of the movable lower portion of the cutting device.

Figures 4, 5, 6, 7, 8:
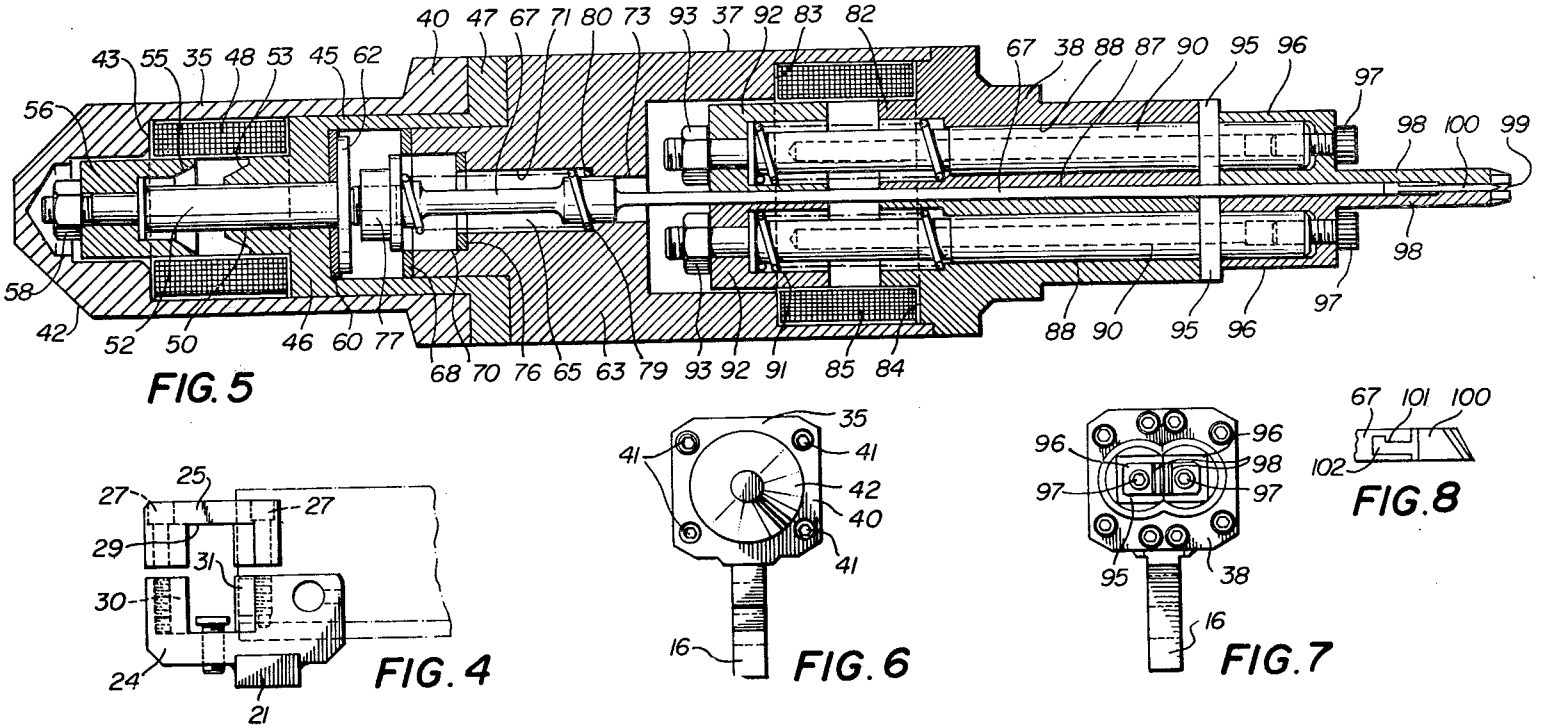
FIG. 4 is a bottom view of the elements of FIG. 2.
FIG. 5 is a longitudinal sectional view taken generally along line V—V of FIG. 3.
FIG. 6 is a plan view of the apparatus of FIGS. 1 to 5.
FIG. 7 is a bottom view of the apparatus of FIG. 6.
FIG. 8 is an enlarged elevation view of the blade portion of the apparatus of FIG. 7.

The casing 1 (FIGS. 5 to 7) includes a top portion 35, a middle portion 37 and a bottom portion 38. The top portion 35 is provided with a peripheral flange 40 for receiving bolts 41 interconnecting the top and middle portions of the casing. The top portion 35 is hollow with a closed, frusto-conical upper end 42 and an internal shoulder 43. A hollow sleeve 45 with a closed upper end 46 and a peripheral flange 47 is mounted in the casing between the top and middle portions 35 and 37, respectively. The flat periphery of the upper end 46 of the sleeve 45 and the shoulder 43 of the top portion 35 define an annular recess for a coil 48, which forms part of an electromagnetic circuit to be described in detail hereinafter. The centre of the upper end 46 of the sleeve 45 is provided with a passage 50, in which a plunger 52 is slidably mounted. The area 53 of the upper end 46 of the sleeve 45 is frusto-conical for mating with a frusto-conical recess 55 in the bottom end of a cap 56 on the upper end of the plunger 52. The cap 56 is retained in position on the plunger 52 by a nut 58 on the threaded upper end of the plunger.

The bottom surface of the upper end 46 of the sleeve 45 is provided with an annular pad 60 formed of a resilient material which acts as a stop for limiting upward movement of a disc 62, which forms the lower end of the plunger 52.

The middle portion 37 of the casing is somewhat similar in shape to the top portion 35 and the sleeve 45, including a closed upper end 63 with a central passage 65 for receiving a second plunger 67, which could be integral with the plunger 52. An annular pad 68 on the upper end 63 of the middle portion 37 around the passage 65 acts as a stop and shock absorber for the disc 62 at the lower limit of its vertical travel. The passage 65 is stepped with a large diameter upper end 70, a medium diameter middle 71 and a small diameter bottom end 73. A step at the bottom of the upper end 70 of the passage 65 is provided with an annular pad 76, which acts as a shock absorber and stop for a nut 77 on the threaded upper end of the plunger 67. A helical spring 79 around the plunger 67 extends between the bottom of the nut 77 and a shoulder 80 at the bottom of the middle 71 of the passage 65.

As in the case of the top and middle portions of the casing 1, the middle and bottom portions 37 and 38, respectively overlap, with an upper end 82 of the bottom portion 38 extending into the middle portion 37. An annular shoulder 83 in the middle portion 37 and the outer, upper end 84 of the bottom portion 38 define an annular recess for a large diameter coil 85, which also forms part of the electromagnetic circuit described in detail hereinafter. The bottom portion 38 of the casing is provided with three passages, including a rectangular central passage 87 through which passes the plunger 67, and a cylindrical passage 88 on each side thereof for a plunger 90. Each passage 88 is stepped near its top end for supporting the bottom end of a helical spring 91 around the plunger 90 and extending upwardly to the upper, inner end of a cap 92 mounted on the top of the plunger 90. The reduced diameter top end of each plunger 90 extends through the otherwise closed top of the cap 92 and is threaded for receiving a nut 93 which holds the cap in place.

Each plunger 90 is provided with a rectangular flange 95 near its bottom end for limiting upward movement of the plunger into the casing 1, which is also rectangular at its bottom end. A presser foot 96 of rectangular cross-section is secured on the bottom end of each plunger 90 by a bolt 97 and extends downwardly along one side of the plunger 67. Each presser foot 96 includes a hollow, substantially square top end, which fits onto the plunger 90, and a rectangular projection 98. The projections 98 of the presser feet define a narrow passage 99 for a blade 100 mounted on the bottom end of the plunger 67. In order to permit easy replacement of the blade 100, the bottom end of the plunger 67 is provided with a key-hole-shaped slot 101 (FIG. 8) for receiving the similarly shaped upper end 102 of the blade. Thus, when the blade 100 requires changing, one of the bolts 97 is removed so that one presser foot 96 can be removed, providing ready access to the blade 100.

It should be noted that while both plungers 90 and presser feet 96 are operated by a single coil 85, the plunger and presser foot on one side of the blade plunger 67 are independent of the plunger and presser foot on the other side of the plunger 67. This feature of the apparatus is important, since, when cutting a strip of material at the edge of a component, it is normal for one presser foot to bear on two thicknesses of material, i.e., a tape and shoe upper component while the other presser foot bears on only one thickness of material, i.e., the tape. It will also be noted (FIGS. 5 and 7) that the plunger 67 is circular in cross-sectional configuration at its top end and rectangular throughout most of the rest of its length for sliding between the presser feet 96.

A throat plate 105 is located beneath the blade 100 in the work surface of the sewing machine. A rectangular throat plate comes with the sewing machine, but a modified throat plate is prepared for the apparatus of the present invention. The modified throat plate 105 includes a slot 106 extending perpendicular to the path of travel (arrow B in FIG. 1) of the tape and shoe components. The end of the throat plate 105 in the area of the slot 106 is widened, since a wide slot in a narrow plate weakens the plate. A pair of photosensors (not shown) are provided beneath the throat plate 105 for detecting the leading and trailing edge of the component and actuating the plungers 52 and 70. Small (approximately 0.02") holes 108 and 109 are provided in the throat plate 105 permitting the passage of infrared light from a source (not shown) above the table through fibres which are glass or plastic to the photosensors located beneath the table. The holes 108 and 109 are located in the path of travel of the tape and component. With this arrangement, the photosensors can be located beneath the sewing table at a position which does not interfere with the parts of the sewing machine, e.g., the feed dog normally located beneath the throat plate 105.

Figure 9:
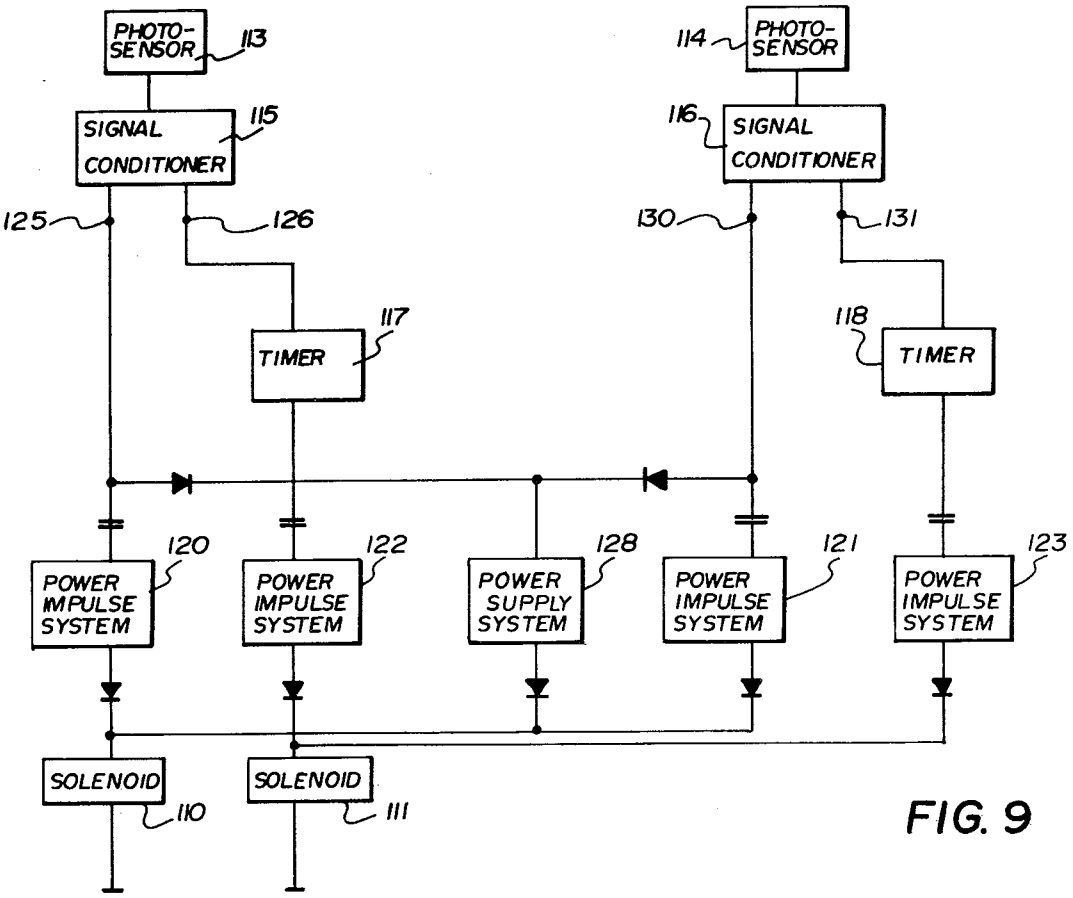
FIG. 9 is a block diagram of a control circuit for use in the apparatus of FIGS. 1 to 8.

The operation of the apparatus of FIGS. 1 to 8 will now be described with reference to FIG. 9. It should be noted that the caps 56 and 92 on the plungers 52 and 90 are formed of a magnetic material such as iron, and thus act as cores of solenoids 110 and 111 (FIG. 9) which include the coils 48 and 85.

The control circuit incorporating the solenoids 110 and 111 includes two photosensors 113 and 114 (referred to hereinbefore, but not shown in FIGS. 1 to 8) which are connected to signal conditioners 115 and 116, timers 117 and 118, and power impulse systems 120, 121, 122 and 123. The energy of such power impulse systems is discharged to the solenoids 110 and 111 to actuate the plungers 52 and 90.

The holes 108 and 109 and consequently the photosensors 113 and 114 are positioned in such a manner that the photosensor 113 (hole 108) is approximately 1 mm in front of the cutting line of the blade 100, and the photosensor 114 (hole 109) is approximately 1 mm behind such cutting line. The photosensor 113 controls the first cut, i.e., the cut at the leading end of a component, and the photosensor 114 controls the second cut, which is the cut at the trailing edge of the component. The photosensor 113 is activated only when covered by the leading edge of a component, and the photosensor 114 is activated only when uncovered by the trailing edge of a component.

When the photosensor 113 is covered by the leading edge of a component, there is a positive pulse of approximately 10 milliseconds at output 125 and a negative pulse of the same duration at output 126 of the signal conditioner 115. The positive pulse activates the power impulse system 120 and thus energizes the solenoid 110 which causes the plungers 90 and presser feet 96 to descend. The presser feet 96 grip the component and tape tensioning them in preparation for a cutting action. Simultaneously, the positive pulse opens the current of a power supply 128 which energizes the solenoid 110 throughout the duration of the positive pulse or tensioning step.

The negative pulse from output 126 of the signal conditioner 115 starts the timer 117, which activates the power impulse system 121 approximately 2 milliseconds after activation of the system 120. The power impulse system 121 energizes the solenoid 111 which causes the plungers 52 and 67 and the blade 100 to descend approximately 2 milliseconds after the presser feet 96. In practical terms, as soon as the photosensor 113 is covered, the solenoid 110 is energized to tension the component and tape, i.e., clamp the component and tape at the leading and trailing ends of the slot 108, and, following a 2 milliseconds delay, the solenoid 111 is energized to effect a cutting action by blade 100.

The second tensioning and cutting actions are carried out in the same manner as the first tensioning and cutting actions, except that the second photosensor 114 is used. After the trailing edge of the component has passed the second photosensor 111, a positive pulse of 10 milliseconds duration appears at output 130 and a negative pulse of the same duration appears at output 131 of the signal conditioner 122. The function of the pulses at outputs 130 and 131 is the same as those at outputs 125 and 126.

Thus, when a tape is sewed onto a plurality of shoe upper components, rather than feeding the components and tape from the machine in sausage-like fashion, the tape is cut at the leading and trailing edges of each component a short distance from where the sewing occurs.

As mentioned hereinbefore, it will be appreciated that some modifications to commercially available sewing machines will be required in order to incorporate the apparatus of the present invention in such machines. Some of the modifications have already been disclosed. Depending on the shape of the presser foot provided with the sewing machine, it may be necessary to alter the presser foot or provide a modified presser foot which will not interfere with the apparatus described hereinbefore. Normally, the presser foot provided with the machine is equipped with a slotted attachment on its outer free end for guiding the tape to be sewed onto the shoe upper components, but, like other elements which do not form part of the present invention, the attachment has not been described in detail herein.

I claim:

1. A cutting apparatus for cutting a strip of material connected to a component and extending beyond at least one edge thereof, the cutting being performed at said one edge, said apparatus comprising blade means for cutting the strip; tension means for tensioning the strip during cutting thereof; first plunger means engaging the tension means; second plunger means engaging the blade means; electromagnetic drive means for moving the first plunger means and tension means from a rest position to a tensioning position on each side of the blade means, and for moving said second plunger means and blade means from a rest position to a cutting position between the tensioning means; sensor means for actuating said drive means when the component and strip are properly located beneath the blade means, said electromagnetic drive means including a core formed of magnetic material on each of said first and second plunger means; first and second coils around said first and second plunger means; and circuit means for energizing said first and second coils sequentially in response to signals from said sensor means, whereby the first plunger means and tension means are moved to the tensioning position before movement of the second plunger means and blade means to the cutting position; and means for returning the blade means, tension means, and first and second plunger means to the rest position.

2. A cutting apparatus according to claim 1, including a casing for said blade means, tension means, plunger means and coil means; and bracket means for adjustably mounting said casing on a sewing machine.

3. A cutting apparatus according to claim 2, wherein said tension means includes a pair of presser feet, one presser foot being slidably mounted on said first plunger means on each side of said blade means, said first plunger means being a pair of plungers in said casing, one plunger being associated with each presser foot for moving said presser foot independently of the other presser foot between the rest and tensioning positions.

4. A cutting apparatus according to claim 1, wherein said sensor means includes photosensors positioned in the path of travel of said component in the area of said blade means; and an infrared light source for illuminating said photosensors.

* * * * *